United States Patent [19]

Richard

[11] Patent Number: 4,653,303

[45] Date of Patent: Mar. 31, 1987

[54] APPARATUS FOR CONTINUOUSLY BRUSHING AND LUBRICATING ROLLS OF ROLLING MILLS FOR FLAT ROLLED PRODUCTS

[75] Inventor: Robert Richard, Cognin, France

[73] Assignee: Cegedur Societe de Transformation de l'Aluminium Pechiney, Paris, France

[21] Appl. No.: 761,381

[22] Filed: Aug. 1, 1985

[30] Foreign Application Priority Data

Aug. 2, 1984 [FR] France ..... 84 12496

[51] Int. Cl.[4] ..... B21B 27/10

[52] U.S. Cl. ..... 72/236; 15/256.52; 118/227; 118/259; 118/262; 72/45

[58] Field of Search ..... 72/43, 44, 236; 15/256.52; 68/202; 118/227, 262, 259

[56] References Cited

U.S. PATENT DOCUMENTS

| | | | |
|---|---|---|---|
| 3,192,757 | 7/1965 | Diolot | 72/236 |
| 3,379,044 | 4/1968 | Kirschner | 72/236 |
| 4,272,976 | 6/1981 | Pizzedaz | 72/236 X |

FOREIGN PATENT DOCUMENTS

| | | | |
|---|---|---|---|
| 2058629 | 4/1981 | United Kingdom | 72/236 |

*Primary Examiner*—R. L. Spruill
*Assistant Examiner*—Steve Katz
*Attorney, Agent, or Firm*—Dennison, Meserole, Pollack & Scheiner

[57] ABSTRACT

Apparatus for continuously brushing and lubricating rolls of rolling mills for rolled flat products without pollution of said products by the lubricant used; it can be used in hot or cold rolling, in particular for Al or alloys thereof.

An enclosure of general parallelepipedic shape which is open on one face and whose opposite sides which are adjacent to the opening are delimited by a circular arc, the radius of which is substantially equal to that of the roll, is applied thereto by way of a continuous resilient peripheral seal. The enclosure which contains the rotary brushes is lubricated by oil circulation and is under a slight depression.

10 Claims, 2 Drawing Figures

APPARATUS FOR CONTINUOUSLY BRUSHING AND LUBRICATING ROLLS OF ROLLING MILLS FOR FLAT ROLLED PRODUCTS

The invention relates to an apparatus for continuously brushing and lubricating rolls of rolling mills for flat rolled products without such products being polluted by the lubricant used; it can be used for hot or cold rolling of metallurgical products, in particular Al and alloys thereof.

In regard to hot or cold rolling of aluminium or alloys thereof, it is known that the surface condition of the product is governed by the surface condition of the rolls and the conditions of lubrication. In conventional rolling, it is difficult to achieve a satisfactory surface condition because of the formation of stains on the product, which are due to the residues of lubricant in the rolling operation itself or when carrying out subsequent treatments such as annealing operations.

Such defects can only be eliminated by additional cleaning and/or degreasing operations (before heat treatment), which are long and expensive processes.

Such difficulties are overcome by using an apparatus for continuously brushing and lubricating the rolls, being the subjectmatter of the present invention and described hereinafter.

For the purposes of this description, it will be assumed that the rolls have their axes horizontal, as is always the case.

An enclosure of general parallelepipedic shape is applied to each of the rolls, preferably on the discharge side, the enclosure being open on one face and the two opposite sides thereof, which are adjacent to the opening, being defined by a circular arc whose radius is substantially equal to the radius of the working rolls; the edge of the opening is provided with a continuous resilient peripheral seal. Each of the enclosures is caused to bear against the corresponding roll by means of pneumatic jacks or any other equivalent means (spring, etc. . . . ). The space defined by the enclosure, the peripheral seal thereof and the corresponding roll is therefore closed and tight.

Disposed in the lower part of the enclosures in parallel relationship with the working rolls and in contact therewith are two rotary brushes (one per enclosure) which are continuously moved mechanically in a single direction, preferably at the same speed and in the opposite direction to the rotary movement of the rolls.

The rotary motion is communicated to the brush shafts in known fashion by a chain driven by a motor. The transmission assembly which is coupled to the motor is disposed in a casing provided with conventional sealing means. In each enclosure, the rolling lubricant is distributed in the upper part and in the vicinity of the same generatrix of the rolls by one or more nozzles (for example 3: one central and two lateral). The nozzles provide for spraying or sprinkling the working roll; the lubricant is then recovered in the bottom of the enclosures from which it is picked up again by a pump. The level of lubricant, as determined by the height of the pick-up pipe or pipes is such that the brushes are immersed therein, up to the vincinity of their axis of rotation.

Lubricant pick-up is effected for example by a displacement pump so as to generate a depression in the enclosure; that provides for avoiding any accidental leakage of the lubricant on to the product in the event of failure or local imperfection in the peripheral sealing means of the enclosure.

Generally, the conditions of use of the two enclosures (nature and speed of rotation of the brushes, lubricant flow rate and depression) in relation to each of the rolls are identical.

The cross-section of the peripheral seal is a point of major importance. It has been found that the seal, which is continuous, must have a cylindrical convex surface along the generatrices of the roll and the corresponding toric surface along the two cross-sections of the roll.

In that way it was possible to achieve a perfect seal between the enclosure and the roll.

The invention will be better appreciated by reference to the following example which is illustrated in the following drawing in which.

Figure 1:
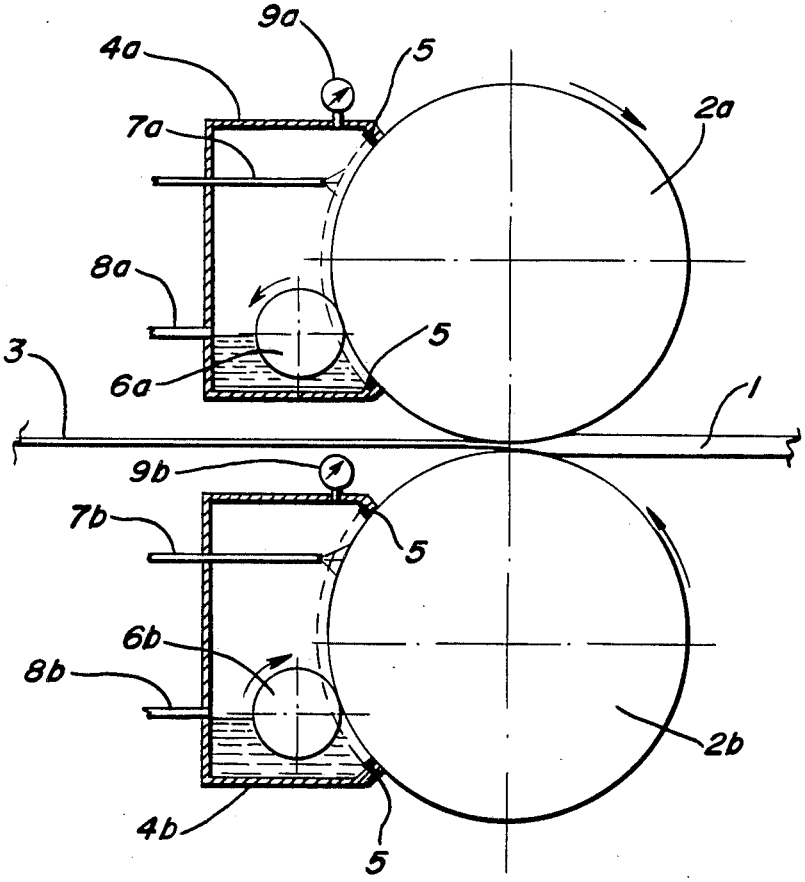
FIG. 1 shows a view in longitudinal section of the apparatus.

The product 1 which is engaged at the upstream side of the working rolls 2*a* and 2*b*, with a diameter of 600 mm, of a two-high rolling mill, issues therefrom in the form of a rolled strip 3. Disposed on the downstream side of the rolls are two enclosures 4*a* and 4*b* which bear against the rolls by way of a peripheral seal 5 under the action of jacks (not shown). Disposed in each of the enclosures are two steel rotary brushes 6*a* and 6*b*, with a diameter of 150 mm, being moved in the direction indicated by the arrows by an electric motor at a speed of 750 rpm. The brushes are caused to bear against the rolls by two pneumatic jacks (not shown) which themselves bear against the rearward wall of the enclosure.

Provided in the upper part of the enclosure are three nozzles or jets 7*a* and 7*b* for distributing the lubricating emulsion at a rate of 10 m3/hour. The emulsion is picked up by the outlet pipes 8*a* and 8*b*. The flow rate of the feed and pick-up pumps (not shown) is so regulated that the vacuum gauge 9*a*, 9*b* installed on the enclosure shows a depression of from 10 to 20 kPa.

It will be appreciated that, in successive roll grinding operations, the diameter of the rolls decreases and the radius of the enclosures is adapted to the profile of the rolls every 6 millimeters.

Figure 2:
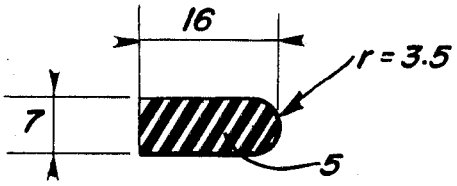
FIG. 2 shows the section and transverse dimensions of one of the seals used.

The peripheral seal 5 used is a seal of PERBUNAN whose cross-section and dimensions are shown in FIG. 2.

It is formed by two straight portions and two sectors which are assembled by glueing.

In the embodiment being considered, the rolling conditions are as follows:

strip of A5 width: 1000 mm
rolling speed (exit): 50 meters/minute
metal entry temperature: 450° C.
entry thickness: 7.5 mm
exit thickness: 3 mm

I claim:

1. Apparatus for lubricating and brushing the surface of the working rolls in a rolling mill for rolling flat products comprising:

at least one enclosure positioned in contact with each roll and including sealing means between said enclosure and said roll;

at least one lubricant feed pipe and at least one lubricant discharge pipe extending into and out of said enclosure for introducing and removing lubricant to the interior of said enclosure;

at least one rotary brush within each enclosure and positioned in contact with said roll and wherein said lubricant discharge pipe is disposed at substantially the same level as the axis of rotation of said brush within said enclosure.

2. Apparatus according to claim 1 wherein the lubricant feed pipe includes at least one nozzle which is disposed in the upper part of the enclosure and is equipped with an end positioned to direct lubricant against said roll.

3. Apparatus according to claim 1 wherein the peripheral sealing means is of a cylindrical convex form corresponding to the roll and the corresponding toric form along the cross-sections of the roll.

4. The apparatus according to claim 1 wherein each said brush is continuously rotated in a single direction.

5. The apparatus according to claim 4 wherein each said brush rotates at the same rotational speed.

6. The apparatus according to claim 4 wherein each said brush rotates in the opposite direction to the corresponding roll.

7. The apparatus according to claim 6 wherein a reduced pressure atmosphere is generated in the enclosure.

8. The apparatus of claim 3 wherein during the rolling operation each brush is continuously rotated in a single direction.

9. The apparatus according to claim 8 wherein each of the brushes rotate at the same speed.

10. The apparatus according to claim 9 wherein each of the brushes rotate in the opposite direction to the corresponding roll.

* * * * *